United States Patent [19]

Kralik

[11] Patent Number: 4,660,831

[45] Date of Patent: Apr. 28, 1987

[54] INFLATABLE PADDED GAME BALL

[75] Inventor: Douglas R. Kralik, Rolla, Mo.

[73] Assignee: Figgie International Inc., Wilmington, Del.

[21] Appl. No.: 776,222

[22] Filed: Sep. 16, 1985

[51] Int. Cl.[4] ..... A63B 41/08

[52] U.S. Cl. ..... 273/65 E; 273/65 ED; 273/65 B

[58] Field of Search ..... 273/65 E, 58 BA, DIG. 20, 273/65 R, 65 EB, 65 EC, 65 ED, 65 EF, 65 EG

[56] References Cited

U.S. PATENT DOCUMENTS

| | | | |
|---|---|---|---|
| 964,888 | 7/1910 | Turner et al. | 273/65 E |
| 1,597,308 | 8/1926 | Brandt | 273/DIG. 20 |
| 2,221,533 | 11/1940 | Voit et al. | 273/65 E |
| 3,119,618 | 1/1964 | Molitor et al. | 273/65 E |
| 4,239,568 | 12/1980 | Takazawa | 273/58 BA |
| 4,462,590 | 7/1984 | Mitchell | 273/65 E |

*Primary Examiner*—George J. Marlo

*Attorney, Agent, or Firm*—Senniger, Powers, Leavitt and Roedel

[57] ABSTRACT

An inflatable padded game ball, such as a football, having an outer carcass, a padding inside the carcass, a liner inside the padding and a bladder inside the liner. The liner is so dimensioned relative to the carcass that the liner establishes the final dimensions of the ball when the bladder is inflated within it. The bladder is air impervious and is formed of multiple layers to increase strength and durability. The liner is also formed of multiple layers including inner and outer woven fabric reinforcement layers and a plastic sheet middle layer for establishing the shape of the ball. The method of constructing such a ball includes a mold of smaller dimensions than the final dimensions of the ball which molds the shape of the inner liner. When the ball is removed from the mold the carcass and padding expand to the final size of the ball.

9 Claims, 8 Drawing Figures

INFLATABLE PADDED GAME BALL

BACKGROUND OF THE INVENTION

This invention relates generally to inflatable game balls and more particularly to a padded game ball constructed to have greater durability and improved playing characteristics, and to a method for making such a game ball.

While this invention is applicable to padded game balls of various types, it is especially applicable to footballs. One of the problems associated with standard non-padded footballs is that they are sometimes relatively difficult to grip, as when they become wet or cold. In an effort to alleviate this problem, padding had been placed between the outer cover and the liner of the ball, thereby making the outer surface of the ball softer and more yielding to the touch. However, the addition of such padding necessitates the use of a thinner liner, which has heretofore resulted in a decrease in the strength and durability of the ball. U.S. Pat. No. 4,462,590, assigned to the same assignee as the present invention, discloses a solution to this problem to which the present invention is an improvement. Other patents of general interest include U.S. Pat. Nos. 1,597,308 and 3,119,618.

SUMMARY OF THE INVENTION

Among the several objects of this invention may be noted the provision of a padded game ball, such as a football, which is adapted to hold its shape over a longer period of time; the provision of such a ball which is relatively lightweight and easy to grip for enabling a player to handle the ball with greater facility and dexterity; and the provision of an economical method for making such a ball.

Generally, an inflatable padded game ball of this invention comprises an outer carcass of relatively tough durable material, a padding disposed within the carcass over substantially its entire inner surface, a liner assembly contained within the carcass, and an air impervious bladder inside the liner assembly comprising at least an inner and an outer layer in engagement with the liner assembly; the liner assembly being so dimensioned relative to the carcass and padding such that the liner establishes the dimensions of the ball when the bladder is inflated within it. The bladder is preferably formed of at least two layers of material. The liner is preferably formed of an outer layer of woven reinforcement, a middle plastic sheet of substantially stable dimensions under normal ball inflation pressure, and an inner woven reinforcement layer.

The method of the present invention generally comprises the making of an inflatable game ball of the type having an inflatable air impervious bladder, a liner around the bladder for limiting expansion of the bladder when it is inflated, an outer carcass forming the outer surface of the ball and a padding between the liner and the carcass for allowing some compression of the carcass relative to the liner, the method comprising: assembling a plurality of layers of bladder material to form a multi-layer bladder; forming a liner of substantially the same shape as the ball and of substantially stable dimension under normal ball inflation pressure; forming a carcass of substantially the same shape as the ball, but of greater dimensions than the liner; forming a padding of substantially the same shape as the ball and of dimensions for fitting between the liner and the carcass; placing the padding inside the carcass; placing the liner inside the padding; and placing the bladder inside the liner.

The preferred method includes placing the ball in a mold having a cavity smaller than the final inflated dimensions of the ball and slightly larger than the final dimensions of the liner to allow for the thickness of the intervening carcass and padding in a compressed state, inflating the bladder in the mold with sufficient pressure to cause the liner to take the shape of the mold, and removing the ball from the mold to allow the carcass to expand to the final shape of the ball due to expansion of the padding outward from the liner. Other objects and features will be in part apparent and in part pointed out hereinafter.

DETAILED DESCRIPTION OF PREFERRED METHODS AND EMBODIMENTS

Figure 1:
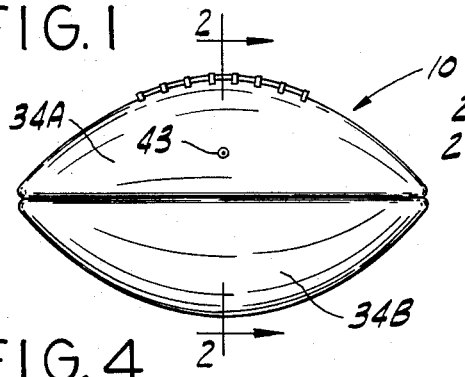
FIG. 1 is a side elevational view of a padded football constructed in accordance with the present invention.
Figure 3:
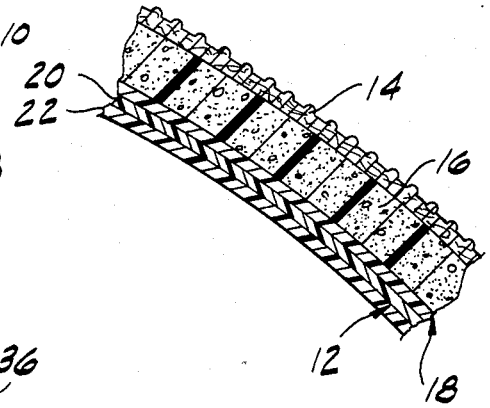
FIG. 3 is an enlarged sectional view of a portion of the football showing the wall construction.
Figure 2:
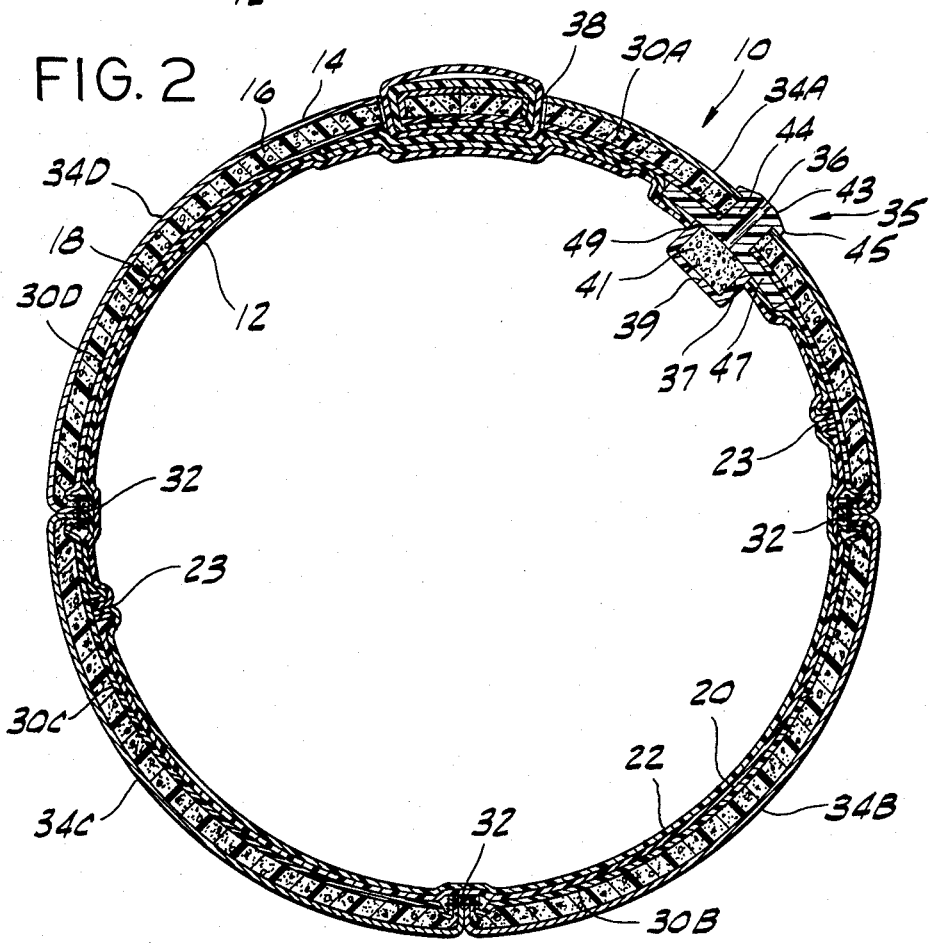
FIG. 2 is a vertical sectional view on line 2—2 of FIG. 1.

Referring to FIGS. 1-3, there is generally shown at 10 an inflated football made in accordance with the present invention, although it is to be understood that other forms of game balls may also be made according to the invention as well. The ball 10 generally comprises a bladder 12, an outer carcass 14, padding 16 and a liner assembly 18.

The carcass 14 is made of relatively tough, durable material, such as leather, having a pebbled surface for better gripability and handling. The padding 16 covers substantially the entire inner surface of the carcass 14 and can be adhered thereto or to the liner assembly 18. The padding 16 is preferably made of a good resilient foam such as neoprene foam.

The bladder 12 is of multi-layer construction, preferably two or four layers, two being shown, an outer layer 20 and an inner layer 22, both made of polyurethane. Each layer comprises two oval panels seamed together at their edges to assume the shape of a football. The seamed edges of the two layers are joined together by glueing or the like as shown at 23 in FIG. 2. This edge securement holds the layers in fixed position relative to one another while allowing them to remain separate over the rest of their surfaces. The multi-layer bladder of the present invention adds substantially to the strength and durability of the bladder over that of a conventional single thickness bladder.

Each of the layers of bladder material is preferably a polyester base with a Shore durometer hardness on scale A of 85-89 and on scale D of 40 with a specific gravity of 1.19-1.20, ultimate elongation of 500%, tensile strength of 5000-5500 psi and a brittle point of −100 degrees F. The total thickness of the bladder 12 is preferably 16 mils divided equally between the layers.

When inflated to a pressure sufficient to expand the liner assembly 18 without stretching it (approximately 13 psi for a football), the bladder 12 is generally of the same shape as the carcass 14, but of smaller dimensions so that it fits within the carcass 14 and within the padding 16 without exerting substantial pressure on the carcass and padding (approximately 1-5 psi), although it should exert some minor pressure on the carcass and padding sufficient to maintain the carcass taut.

Figure 6:
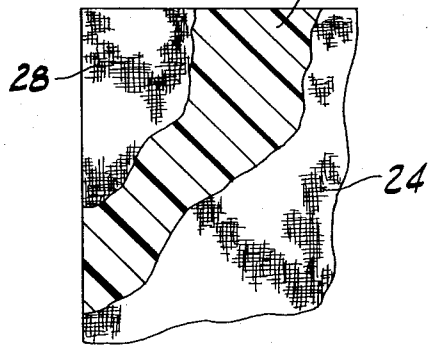
FIG. 6 is a partial view of the liner assembly with portions of the layers removed.
Figure 7:
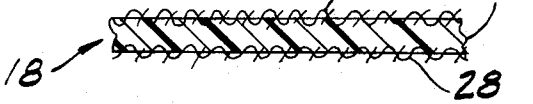
FIG. 7 is a cross-sectional view of the liner assembly.

The liner assembly 18 is also of a multi-layer construction as best seen in the enlarged views thereof in FIGS. 6 and 7. As shown in FIG. 6, there is an outer reinforcement layer 24 made of woven fabric, preferably polyester, a control layer 26 of sheet material, preferably ethylene vinyl acetate, and an inner reinforcement layer 28 of the same material as outer layer 24. As shown in FIG. 7, the outer and inner woven reinforcement layers 24 and 28, respectively, are embedded in the middle layer 26. This is done immediately after extrusion of the middle layer before it has set, by embedding the inner and outer layers 24 and 28 in it through the use of rollers or the like.

The liner assembly 18 establishes the basic shape of the ball, as discussed in more detail below, and therefore must be sufficiently elastic when deformed to return to its original shape. The laminated construction of liner assembly disclosed herein is believed to accomplish this. The inner and outer layers 28 and 24 are both made of woven 100 percent polyester with the cloth having a weight of approximately 3.4 ounces per square yard. The middle layer 26 of ethylene vinyl acetate is preferably composed of 28 percent vinyl acetate and 72 percent ethylene, having a specific gravity of 0.95, elongation of 750 percent at ambient, tensile strength of 2500 pounds per square inch at ambient and a Shore A durometer hardness of 86. It is contemplated that other liner assemblies could be utilized, so long as they provide the requisite strength and expansion restraining properties to give shape and durability comparable to the above example. The fact that the liner assembly reduces the pressure exerted on the inside of the carcass is further advantageous in that this avoids excessive compression of the padding 16 which would reduce its effectiveness in producing a softer more yielding ball to aid in grippability thereof.

Figure 4:
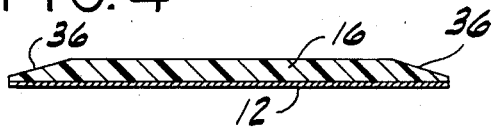
FIG. 4 is a cross-sectional view of a combined quarter panel of carcass and padding.
Figure 5:
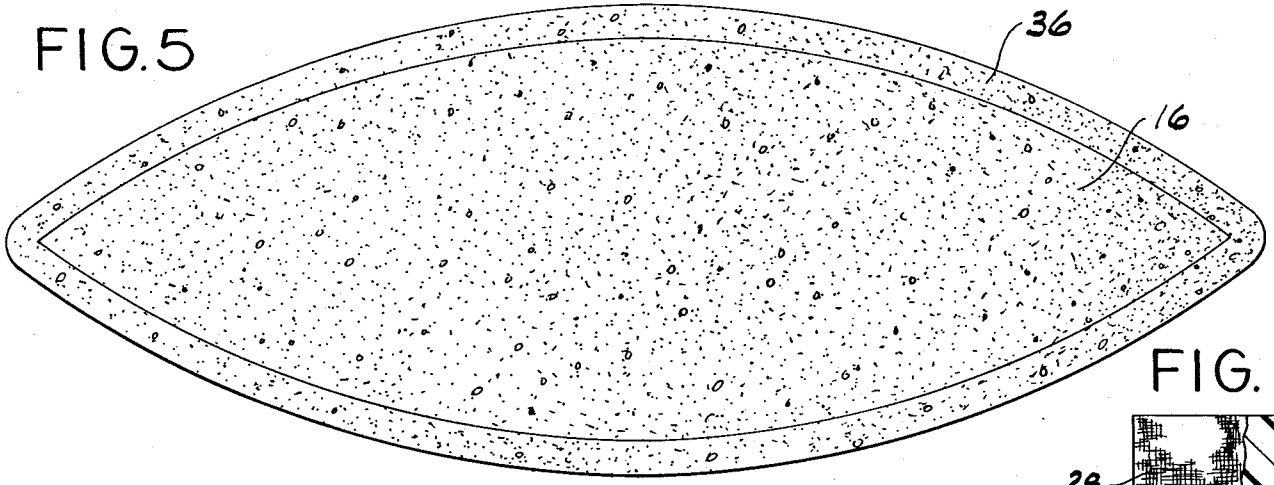
FIG. 5 is a plan view of a quarter panel of padding.

The liner assembly 18 is formed from a plurality of panels, preferably four panels 30A-30D, each of which is generally oval in shape with relatively sharply tapered ends. These panels are joined edge-to-edge with adjacent edge margins of adjacent panels seamed together (e.g., by stitching) in face-to-face relation along with the carcass 14 and padding 16 to form inwardly projecting seams 32, as shown in FIG. 2. The carcass is also divided into four sections designated 34A-34D, as shown in FIG. 2, each being generally oval in shape with relatively sharply tapered ends. The padding is similarly shaped ( FIGS. 4 and 5) but has beveled edges 36 on its inner surface to reduce the thickness of the seams 32.

To inflate the bladder, the latter is provided with a valve 35 comprising a valve nipple 43 having a passage 36 with inlet and outlet ends for insertion of a conventional needle valve (not shown) therethrough from the inlet end of the passage. The nipple 43 projects outwardly through the liner assembly 18, padding 16 and carcass 14. The valve 35 has a cylindrical inner chamber 37 at the outlet end of the passage 36 with a hole 39 in communication with the interior of the bladder. Disposed within chamber 37 is a sealing member 41 which is made of natural rubber, although any soft self-sealing material may be utilized. The sealing member 41 prevents the escape of air from the bladder via passage 36 and can be penetrated by the conventional filling needle valve (not shown) so that the needle can pass into the interior of the bladder to fill it with air. When the needle is withdrawn, the plug reseals to close off the hole 39 from the outside. The valve body 44 is made of a polyester material similar to that used to make the bladder 12. It has a Shore A durometer hardness of 82-85, tensil strength of approximately 9000 psi, ultimate elongation of 500% and a low temperature brittle point of −80 degrees F.

The valve nipple 43 has a circular lip 45 for sealing against the outer surface of the carcass and a circular flange 47 is formed in the middle of the valve body 44 for sealing against the inside surface of the liner assembly. The bladder is provided with a hole 49, the edges of which seal against the cylindrical inner chamber. The outer surface of the bladder seals against the flange 47.

The valve 35 is designed to be especially useful in sealing a ball made in accordance with the construction of the present invention. In such a ball, the distance from the interior of the bladder to the surface of the carcass is greater than in conventional ball constructions and the padding and carcass would tend to push outward in the area of the valve if a conventional valve nipple construction were utilized. The flange 47 and lip 45 are separated the appropriate distance to receive the layers of carcass, padding and liner between them to prevent the layers from pushing outward.

In the method of the present invention, a game ball, such as football 10, is formed by first forming the various components described above and then assembling them. In addition, in one form of the method of the present invention, the assembled components are placed in a mold and then expanded to cause the ball to take the shape of the mold as described in more detail below.

The liner assembly 18 can be made by forming a plurality of panels of the requisite size and shape, as mentioned above. Thus, as depicted in FIG. 2, two of the four panels (designated 30A and 30B) are joined to form one half of the liner assembly 18. The other two panels (designated 30C and 30D) are joined in similar fashion to form the other half of the liner assembly.

The carcass 14, padding 16 and liner assembly 18 are all formed in panels similar to those described above as to the liner and are preferably sewn together at 34 in four places about the ball 10. This can be done by first joining two separate sets of quarter-panels and then sewing the two halves thus formed together except in the area of the opening 38 which is laced in a conventional manner.

The liner assembly 18 of the game ball 10 and padding 16 can be formed into a laminated assembly for ease of production. This can be done by taking large sheets of liner and padding and glueing them together to form a laminated sheet. A plurality of panels of appropriate size and shape are then cut from this laminate.

Assuming that a football carcass is to be made, the panels cut from such a laminated sheet are ovaloid with relatively sharply tapered ends. The padding is preferably then beveled (skived) at 36 to reduce the thickness of the final seam 32. Four such panels are then sewn together, as mentioned above, along with the liner assembly (the four panels, each of which comprises a layer of carcass, a layer of padding and layers corresponding to the liner assembly, may be referred to as composite panels) to form a hollow football-shaped shell comprising the carcass with the foam padding and liner assembly inside.

The bladder 12 is inserted through the opening 38 and the valve nipple 43 inserted in the corresponding opening in the assembly of carcass, padding and liner. The bladder may then be inflated to expand the liner assembly until it substantially conforms to the inside walls of the carcass. As noted hereinabove, the material out of which the liner assembly 18 is made is sufficiently strong that the force exerted against the inside of the carcass is relatively small (e.g., 1–5 psi in the case of a football) so as not to subject the carcass to excessive internal pressures which would otherwise tend to cause the carcass to lose its shape relatively quickly. Besides restraining the expansion of the bladder and thereby reducing the pressure exerted on the carcass, the liner assembly also provides some protection against puncture of the bladder assembly 12.

Figure 8:
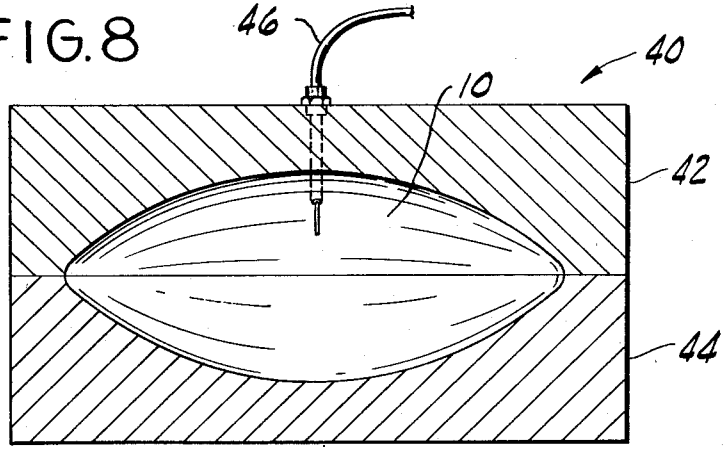
FIG. 8 is a schematic view in cross-section of a mold for forming a ball.

As previously mentioned, one preferred method of the present invention involves placing the ball (formed generally in the manner described above) in a mold as shown in FIG. 8. The mold 40 is formed of two parts 42 and 44 which, when closed, define a mold cavity in the shape of the ball 10, but of smaller dimensions than the final inflated dimensions of the ball, but slightly larger than the final inflated dimensions of the liner assembly 18 to allow for the thickness of the carcass and compressed padding 16. The cavity is designed so that the liner assembly 18 is allowed to expand to its final dimensions within the padding and carcass in order to establish the shape of the ball.

When the bladder assembly is expanded by introducing air into it through the valve 35 by the air supply conduit 46 it expands outwardly against the liner assembly. The liner assembly, in turn, expands against the foam padding 16 which is compressed against the carcass 14 being constrained from expansion by the mold 40. After a brief period of holding the ball in the mold in the inflated condition, the mold is opened and the ball removed. As the ball is removed, and the carcass of the ball is no longer constrained against expansion, it expands outwardly under the pressure of the expanding foam padding to take the final shape of the ball. The limited pressure exerted on the foam padding by the liner assembly allows the carcass to be compressed slightly when gripped to inhance the grippability of the ball.

As various changes could be made in the above constructions and methods without departing from the scope of the invention, it is intended that all matter contained in the above description shall be interpreted as illustrative and not in a limiting sense.

What is claimed is:

1. An inflatable padded game ball, comprising:

an outer carcass of relatively tough durable material;

padding disposed within the carcass and engaging the carcass over substantially its entire inner surface;

a liner assembly contained within the carcass on the inside of the padding and engaging the padding over substantially its entire inner surface; and an air impervious multi-layer bladder inside the liner assembly engaging the liner assembly over substantially its entire inner surface and comprising at least an inner and an outer simultaneously expandable layer;

the liner assembly comprising at least two layers, including a layer of plastic sheet material having a shape, under normal ball inflation pressures, substantially conforming to the final inflated shape of the game ball and being substantially dimensionally stable to hold said shape under said normal ball inflation pressures, and an outer layer adjacent the padding.

2. An inflatable padded game ball as defined in claim 1 wherein the bladder is comprised of two to four layers secured together.

3. An inflatable padded game ball as defined in claim 2 wherein the bladder layers are made of polyurethane material.

4. An inflatable padded game ball as defined in claim 1 wherein the padding is foam padding in engagement with the carcass, wherein the outer layer of said liner assembly is of fabric, and wherein the liner assembly further includes an inner layer of fabric adjacent the bladder.

5. An inflatable padded game ball as defined in claim 4 wherein the inner and outer fabric layers are made of a woven polyester material and the plastic sheet is ethylene vinyl acetate.

6. An inflatable padded game ball as defined in claim 5 wherein the inner and outer woven fabric layers are embedded in the plastic sheet.

7. An inflatable padded game ball as defined in claim 1 wherein the liner assembly restrains expansion of the bladder beyond predetermined dimensions and the padding expands outwardly from the liner assembly against the carcass to support the shape of the carcass.

8. An inflatable padded game ball as defined in claim 1 wherein the ball is provided with a valve comprising a valve nipple having a passage with an inlet end and an outlet end for insertion of a needle valve therethrough from the inlet end of the passage, a chamber at the outlet end of the passage in communication with the interior of the bladder, and a sealing member in the chamber for sealing against the escape of air from the bladder through the passage, the sealing member being of a soft self-sealing material whereby it is adapted to be penetrated by the needle valve to permit inflation of the bladder and to self-seal when the needle valve is withdrawn from the passage, said valve nipple having a lip for sealing against the outer surface of the carcass and a flange for sealing against the inside surface of the liner assembly.

9. An inflatable padded game ball as defined in claim 1 wherein the padding is formed of panels generally oval in shape with relatively sharply tapered ends and an inner surface of each panel is beveled on its edges so as to reduce the thickness of the seam formed by sewing the carcass, padding and liner assembly together to form the ball.

* * * * *